United States Patent [19]

Bourcier et al.

[11] Patent Number: 4,999,548

[45] Date of Patent: Mar. 12, 1991

[54] PICTURE ANALYSER TUBE WITH STREAK COMPENSATION

[75] Inventors: Henri Bourcier, Marolles En Brie; Francois X. Doittau, Paris, both of France

[73] Assignee: U.S. Philips Corp., New York, N.Y.

[21] Appl. No.: 414,604

[22] Filed: Sep. 26, 1989

Related U.S. Application Data

[63] Continuation of Ser. No. 196,901, May 19, 1988, abandoned.

[30] Foreign Application Priority Data

May 22, 1987 [FR] France ..... 87 07220

[51] Int. Cl.[5] ..... H01J 29/56

[52] U.S. Cl. ..... 315/370; 313/103 CM; 358/222; 358/223

[58] Field of Search ..... 315/370; 358/222, 223; 313/103 CM

[56] References Cited

U.S. PATENT DOCUMENTS

| | | | |
|---|---|---|---|
| 3,577,205 | 5/1971 | Hobrough . | |
| 4,015,115 | 3/1977 | Corcoran | 358/901 |
| 4,245,254 | 1/1981 | Svensson et al. | 358/222 |
| 4,303,945 | 12/1981 | Fawcett et al. | 358/222 |
| 4,355,229 | 10/1982 | Zimmerman et al. | 313/528 |
| 4,471,378 | 9/1984 | Ng | 358/110 |

FOREIGN PATENT DOCUMENTS

| | | |
|---|---|---|
| 0031732 | 7/1981 | European Pat. Off. . |
| 0509776 | 8/1939 | United Kingdom . |

OTHER PUBLICATIONS

Mullard Technical Communications No. 126, 4/75, "Image Intensifiers", pp. 247-251.

La Recherche, vol. 11, No. 110, 4/80, pp. 404–411, "Les Detecteur . . . ".

*Primary Examiner*—Theodore M. Blum

*Attorney, Agent, or Firm*—William L. Botjer

[57] ABSTRACT

A picture analyser tube with streak compensation constituted by a light intensifier tube structure comprising a photocathode (1) associated with an acceleration grid (2) and a microchannel plate (3) associated with an acceleration grid (4) coupled to an electron-sensitive (6) or photosensitive objects (7) CCD matrix. The wire compensation effect is obtained, for example, by deflecting the electron beam issued by the photocathode (1) by means of electromagnetic coils (5) traversed by currents the intensities of which are controlled in order that the deflection movement of the said beam is opposite to the movement of the picture during the duration of the passage of the object in the field of view of the device. The picture is thus immobilized in the plane of the CCD detector.

9 Claims, 1 Drawing Sheet

PICTURE ANALYSER TUBE WITH STREAK COMPENSATION

This is a continuation of application Ser. No. 196,901, filed May 19, 1988 now abandoned.

BACKGROUND OF THE INVENTION

The invention relates to a picture analyser tube with streak compensation for the immobilisation of the picture of a moving object and constituted by a light intensifier tube structure comprising a photocathode associated with an acceleration grid and a microchannel plate associated with another acceleration grid coupled to a CCD matrix.

Such a device is used, for example, in observation cameras of faintly luminous mobile objects and in the star gazer from a vehicle having angular movements in a Galilean reference plane.

The relative movements object-aiming device produce a streak effect, that is to say the display of smudges on the CCD detector.

It is the object of the invention to compensate for this effect during the time of taking the image by the camera or during the integration time during the observation of the constellation. So the pictures are immobilized in the plane of the CCD detector. The result is correlatively a considerable amelioration of the signal-to-noise ratio.

SUMMARY OF THE INVENTION

According to the invention, the streak compensation effect is obtained by introducing in the said intensifier tube structure, between the acceleration grid associated with the photocathode and the microchannel plate, a deflection means and focusing means of the electron beam from the photocathode, of the type as is used in a picture dissector tube, the said deflection being opposite to the known movements of the picture in order to immobilise it in the picture plane of the CCD detector during the whole passage of the object observed in the field of view of the device.

Said deflection means may be electromagnetic or electrostatic.

BRIEF DESCRIPTION OF THE DRAWING

The invention will now be described in greater detail, by way of example, with reference to the drawing, in which.

DETAILED DESCRIPTION OF THE INVENTION

Figure 1A:
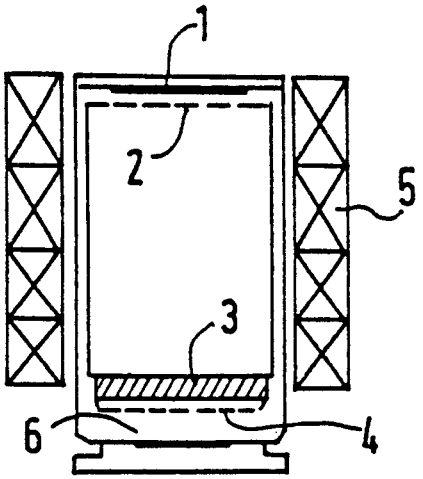
FIGS. 1*a* and 1*b* show diagrammatically two embodiments according to the invention integrating an electromagnetic deflection system.
Figure 1B:
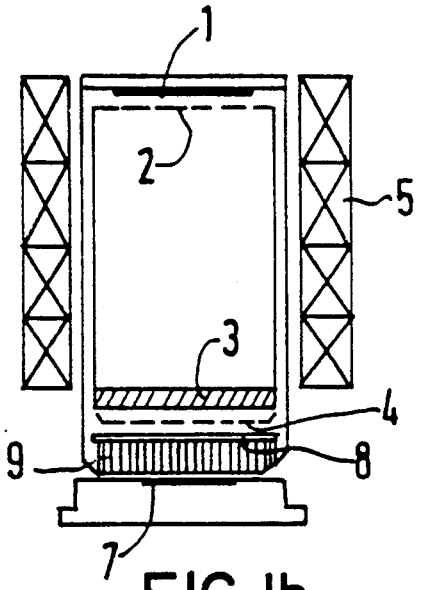

FIGS. 1*a* and 1*b* show the light intensifier tube structure comprising at its front end a photocathode 1 associated with an acceleration grid 2 nd, at the rear end, a microchannel plate associated with another acceleration grid 4. Said intensifier tube structure is surrounded by deflection and focusing coils 5.

In a first modified embodiment shown in FIG. 1*a* an electron-sensitive CCD matrix 6 is coupled directly to the acceleration grid 4.

In a second modified embodiment shown in FIG. 1*b* a photosensitive CCD matrix 7 is coupled to the acceleration grid 4 via a luminescent screen 8 and a network of optical fibres 9.

For these two embodiments the operation is as follows:

The incident photons are converted into electrons by the photocathode 1.

The electrons are accelerated towards the grid 2, deflected in accordance with currents circulating in the deflection coils 5 and focused by the said coils on the input face of the micro channel plate 3.

The current values in the coils are determined in accordance with the known movement of the picture in such a manner that the deflection of the electron beam from the photocathode is opposite to said movement during the passage of the object in the field of view of the device.

The number of electrons from the microchannel plate 3 is amplified by the value of the gain of the plate.

The emanating electrons are accelerated toward the grid 4 to be:

either focused directly on the electron-sensitive CCD matrix, the device is then termed restoning electron-sensitive CCD (FIG. 1*a*), or converted into photons by the luminescent screen 8 and injected in photosensitive CCD matrix 7 coupled to the luminescent screen by the network of optical fibres 9, the device is then termed restoning photosensitive CCD (FIG. 1*b*).

Figure 2A:
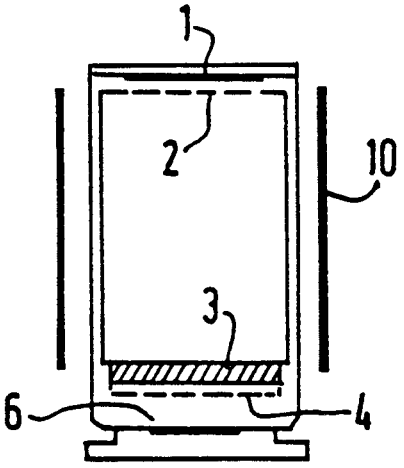
FIGS. 2*a* and 2*b* show diagrammatically two embodiments of the above device integrating an electrostatic deflection system.
Figure 2B:
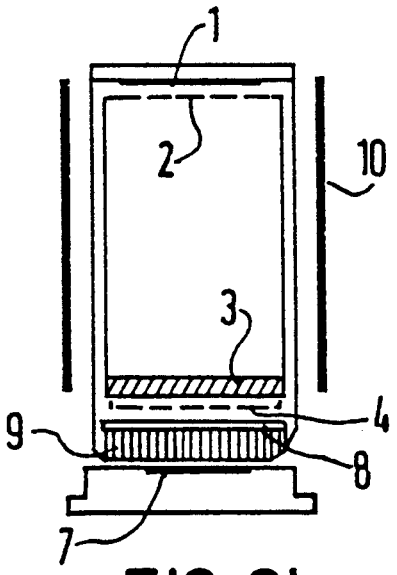

The modified embodiment shown in FIGS. 2*a* and 2*b* are identical to those shown in FIGS. 1*a* and 1*b*, respectively, only that the deflection means of the electron beam is constituted by electrostatic plates 10 held at potentials which control the deflection of the beam in the direction opposite to the movement of the picture during the passage of the object in the field of view of the device.

The major interest of said devices reside in their capacity of immobilizing in the CCD image plane a mobile image the movements of which are known by exploiting a deflection system integrated in the device.

Said devices are equipped to operate in a vacuum. They combine the advantage off an image dissector type structure for the access to the measure of flux received by any element of the photocathode with that of a CCD matrix which is to store the signals received by the assembly of elements.

What is claimed is:

1. An image intensifier tube with streak compensation for the immobilization of the picture of a moving object and constituted by a light intensifier tube structure comprising a photocathode associated with an acceleration grid and a microchannel plate associated with another acceleration grid coupled to a CCD matrix, characterized in that the effect of streak compensation is obtained by introducing in the said structure, between the acceleration grid associated with the photocathode and the microchannel plate, a deflection means of the electron beam from the photocathode, of the type as is used in a picture dissector tube, the said deflector being opposite to the known movement of the image in order to immobilize it in the picture plane of the CCD detector during the duration of the passage of the object observed in the field of view of the device.

2. An image intensifier tube as claimed in claim 1, characterized in that the said deflection and focusing means of the electron beam is constituted by electromagnetic coils disposed around the said structure of the intensifier tube, the said deflection being affected as a function of the controls of the intensities of the current traversing the said coils.

3. An image intensifier tube as claimed in claim 1, characterized that the said deflection and focusing means of the electron beam is constituted by electrostatic plate disposed around the said intensifier tube structure, the said deflection being effected as a function of the controls of the voltages of the said plates.

4. An image intensifier tube as claimed in claim 1 characterized in that the said CCD matrix is an electron-sensitive matrix disposed rearwardly of, and proximate to the acceleration grid of the microchannel plate.

5. An image intensifier tube as claimed in claim 1 characterized in that the said CCD matrix is a photosensitive matrix coupled with the acceleration grid of the microchannel plate via a luminescent screen and a network of optical fibres.

6. An image intensifier tube for immobilizing an image of a moving object comprising a light intensifier tube structure including a photocathode associated with a first accelerating grid and a multi-channel plate associated with a second acceleration grid coupled to a CCD matrix, streak compensation means disposed between said first acceleration grid and said multi-channel plate, said streak compensation means including deflector means for deflecting the electron beam from the photocathode, said deflection means deflecting said electron beam in a direction opposite that of the motion of the image of the moving object in order to immobilize the image in the plane of the CCD matrix during the passage of the object in the field of view of the device.

7. The image intensifier tube as claimed in claim 6 wherein said deflection means comprise electrostatic plates disposed around said tube structure, the deflection of said electron beam being a function off the voltages applied to said plates.

8. The image intensifier tube as claimed in claim 6 wherein said deflection means of said electron beams comprise electromagnetic coils disposed around said tube structure, said electron beam deflection being effected as a function of the intensity off the current traversing said coils.

9. The image intensifier tube as claimed in claim 6 wherein said CCD matrix is a photosensitive matrix coupled with the acceleration grid of said microchannel plate by means of a luminescent screen and a network of optical fibers.

* * * * *